United States Patent [19]

Stark

[11] 4,161,034

[45] Jul. 10, 1979

[54] CORRELATION APPARATUS

[75] Inventor: Edward W. Stark, Garden City, N.Y.

[73] Assignee: Sperry Rand Corporation, New York, N.Y.

[21] Appl. No.: 243,163

[22] Filed: Dec. 7, 1962

[51] Int. Cl.[2] ..... G06G 7/19

[52] U.S. Cl. ..... 364/822; 364/604; 364/819

[58] Field of Search ..... 235/181, 174; 250/83.3, 250/203, 232, 233; 88/14 PL; 364/822, 604, 819, 820; 343/100 CL

[56] References Cited

U.S. PATENT DOCUMENTS

| | | | |
|---|---|---|---|
| 3,147,373 | 9/1964 | Clynes | 364/604 |
| 3,157,874 | 11/1964 | Altar et al. | 364/822 |

*Primary Examiner*—Howard A. Birmiel

*Attorney, Agent, or Firm*—Howard P. Terry

EXEMPLARY CLAIM

1. Signal handling apparatus comprising summing means adapted to receive simultaneously signals representing a function taken at one or more different phases of time, means providing simultaneously a plurality of signals representing said function taken at various phases of time, a plurality of multiplying means each of which receives the output signal from said summing means and one of the simultaneously provided function signals, and a plurality of integrating means simultaneously receiving the product output signals from respective multiplying means, whereby peak output signals from said integrating means is indicative of which respective multiplying means receive simultaneously provided signals having the same phases as the phases of the input signals to said summing means.

9 Claims, 7 Drawing Figures

RETICLE SECTION AT POSITION 1

INTEGRATING SCREEN ILLUMINATED POSITIONS

Figure 1:
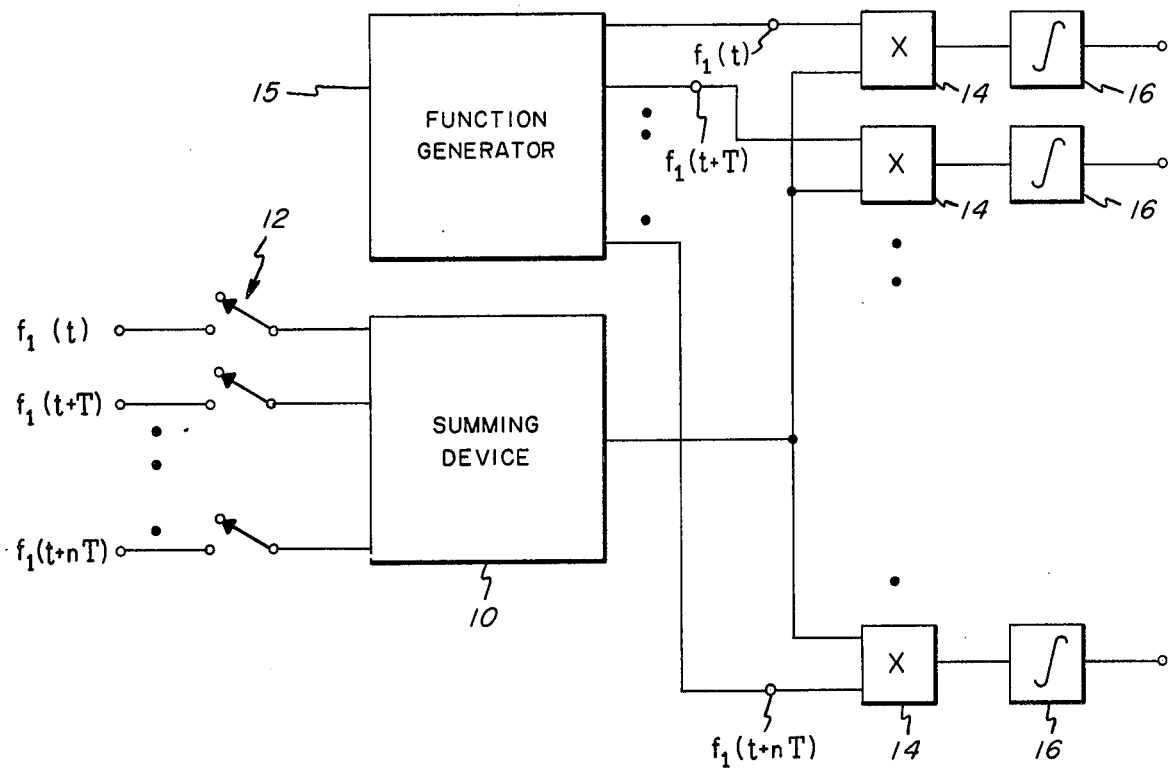

| a | b | c | d | e | f | g | h | i | TOTAL |
|---|---|---|---|---|---|---|---|---|---|
| 1 | 1 | 1 | 1 | 1 | 1 | 1 | 1 | 1 | 9 |
| | | 2 | | 2 | | 2 | 2 | | 4 |
| 3 | | | 3 | | 3 | 3 | | | 4 |
| | | 4 | 4 | 4 | 4 | | | | 4 |
| | 5 | 5 | | 5 | 5 | | | 5 | 5 |
| | 6 | | 6 | 6 | | | 6 | | 4 |
| 7 | | 7 | 7 | | | 7 | | 7 | 5 |
| 8 | 8 | 8 | 8 | | | | 8 | | 5 |
| | 9 | 9 | | | 9 | 9 | | | 4 |
| 10 | | | 10 | 10 | | | | | 3 |
| 11 | 11 | | | | 11 | | | 11 | 4 |
| | 12 | | 12 | 12 | | | 12 | 12 | 5 |
| 13 | 13 | | 13 | | | 13 | 13 | | 5 |
| 14 | | | 14 | | | 14 | | 14 | 4 |
| 15 | | | 15 | | 15 | | 15 | 15 | 5 |
| | | | | 16 | 16 | 16 | 16 | | 4 |
| | 17 | | | 17 | | 17 | | 17 | 4 |
| | | | 18 | | 18 | | 18 | 18 | 4 |

CORRELATION APPARATUS

The present invention relates to correlators and in particular provides:

1. A device capable of producing simultaneously a plurality of signals representing not only one function taken at different times, but any number of functions taken at such different times, and 2. A multichannel correlator by making use of the fact that if signals representing various functions taken at one or more times are summed, the resulting sum signal when applied simultaneously to different correlator channels (each being adapted to receive as a multiplier signal a respective function signal taken at a different time) gets broken into its constituents, with each such constituent appearing as filterable noise in every channel except its respective channel.

As is known, correlators produce indications of the similarity and/or time relationship between signals representing functions of time by taking the time integral of the product of the two signals as one signal is successively taken at different phases (of time) and the other is continually taken at the same phase (of time). See for example U.S. Pat. Nos. 2,676,206 and 3,036,775 which describe correlators and the theory on which they operate. To take one of the multiplier signals at successive phases of time, use is made in the prior art of delay lines, shift registers, etc., which inherently cannot operate to provide instantaneous indications of correlation.

Among prior art correlators, distinctions are often made between auto- and cross-correlators: the former being used for example to compare an applied signal with itself for start-stop time measuring purposes as in radar, the transmitted signal being correlated with its echo; the latter being used to compare one signal with any other reference signal as, for example, for discrimination purposes.

In a presently preferred form of the invention, the auto- and cross-correlator functions are combined by correlating one signal deliberately made to vary as a special function of time, not with any reference signal or with itself, but with a locally produced reference signal which is made to vary as that same function of time: hence, the combined auto-cross correlation. Further, by shifting in such presently preferred form from a "time" domain to a "space" domain, e.g., each point of a ring in a plane of space is made the analogue of a function taken at a different phase (of time), the prior art requirement for "delaying" components is obviated, thereby permitting the above-mentioned "successive" multiplications to be made simultaneously. This shift to a space domain also provides the added advantage of multichannel correlator operation, i.e., different rings in a given plane of space for different functions of time. This will be explained in detail later.

A principal object of the invention is to provide a correlator that affords instantaneous indications of the correlation between signals.

Another object of the invention is to provide a correlator that combines aspects of both auto- and cross-correlators and provides simultaneously signals representing functions of a variable taken at different phases of time.

Another object of the invention is to provide a multichannel correlator that provides instantaneous indications of correlation for different sets of signals.

Another object is to provide an optical correlator that minimizes the equipment necessary for instantaneous and multichannel operation.

Another object is to provide an electrical correlator according to the invention.

Figure 2:
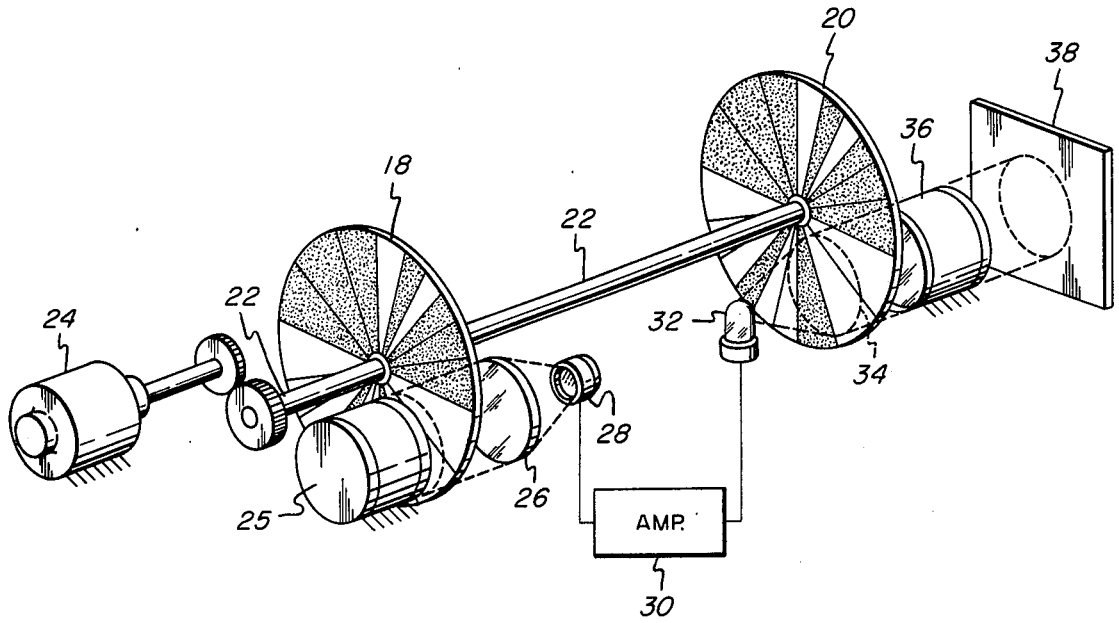
Figure 3:
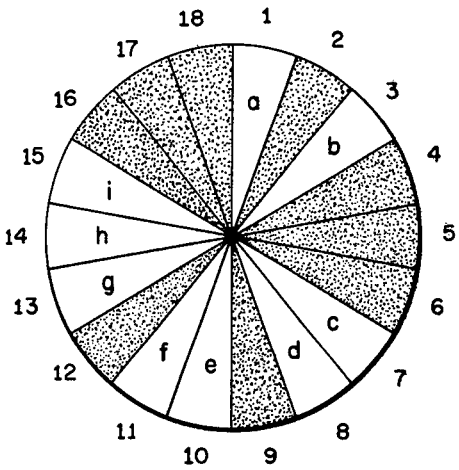
Figure 4:
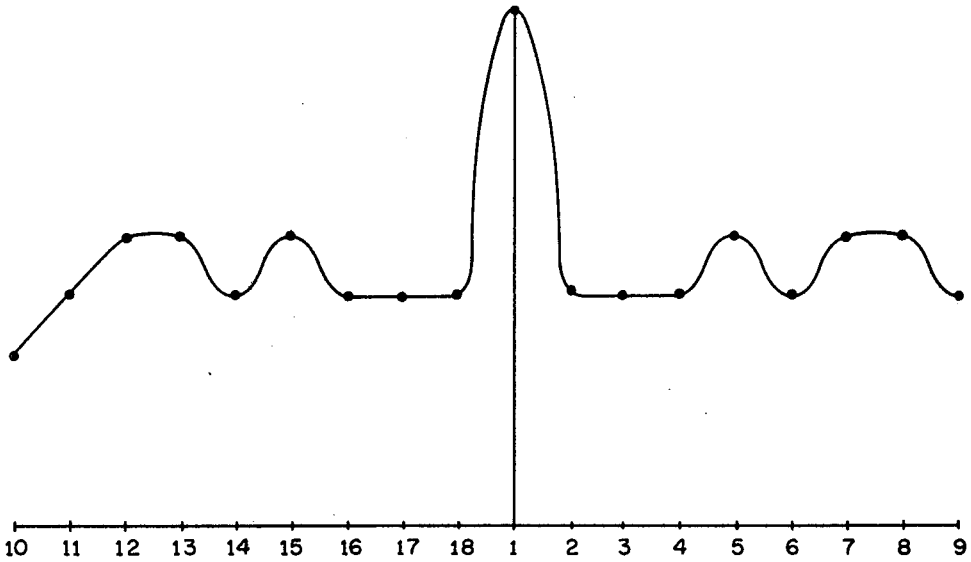
Figure 5:
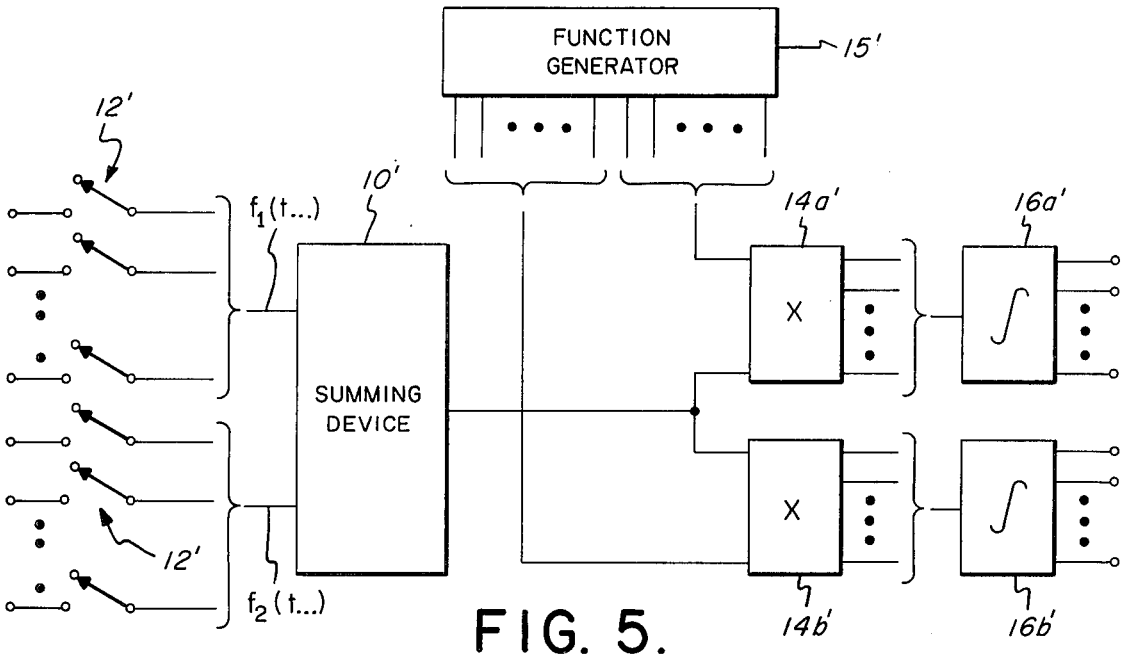
Figure 6:
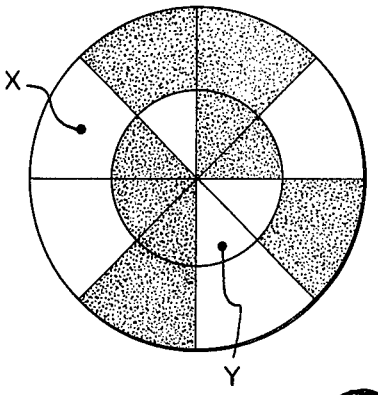
Figure 7:
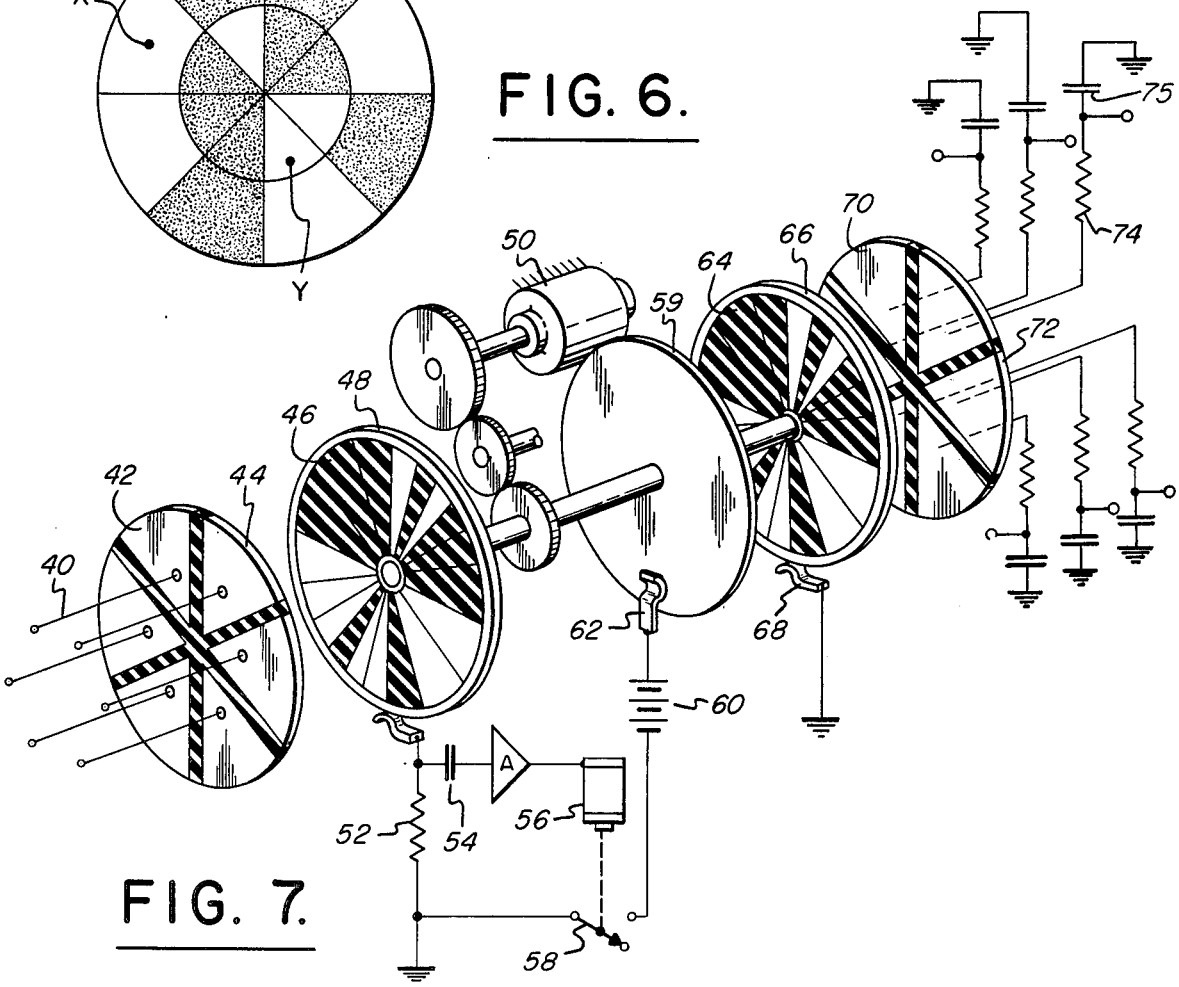

The invention will be described with reference to the figures wherein:

FIG. 1 is a block diagram showing how the principal concepts of the invention are embodied, FIG. 2 is a schematic arrangement of elements that incorporates the aforementioned principal concepts in a simple way, FIG. 3 shows an arbitrarily coded reticle useful in describing how the apparatus of FIG. 2 can be used for single-channel correlation, FIG. 4 is a correlellogram derived using the reticle of FIG. 3, FIG. 5 is a block diagram showing how the apparatus of FIG. 1 may be extended for multichannel operation, FIG. 6 is a diagram for showing how reticles employed with the apparatus of FIG. 2 may be changed to make that apparatus useful for multichannel operation; and FIG. 7 depicts an electrical correlator (built along the lines of the apparatus of FIG. 2) embodying the invention.

Referring to FIG. 1 a summing device 10 is shown adapted to receive, through a plurality of normally open switches 12, signals representing a particular function $f_1$ of a variable taken at different phases of time, i.e., at different time displacements O, T, 2T . . . nT, etc., from a reference time. The output sum signal from the summing device 10 is applied simultaneously to a plurality of gates or multiplying devices 14, each of which simultaneously receives from a function generator 15 a locally produced multiplier signal representing the same function as is represented by the signals applied to the summing device 10, such locally produced signals being each, however, respectively taken at different phases of time, i.e., at a different time displacement with respect to a reference time. The product output signals from the multiplying devices 14 are applied then simultaneously to respective integrators 16, the output signals of which peak only when respective switches 12 are closed, i.e., when signals representing the function taken at particular phases of time are applied to the summing device 10.

How the apparatus of FIG. 1 operates to compute correlation functions can best be described in conjunction with the apparatus of FIG. 2 (which operates in a specific way, i.e., in an optical environment, according to the apparatus of FIG. 1).

Referring then to FIG. 2, two reticles 18 and 20, respectively input and output reticles, are simultaneously and rotatably driven by a shaft 22 when a motor 24 is energized. The reticles 18 and 20 are identically coded with opaque and clear section and are so secured to the shaft 22 that their respective code patterns are circumferentially aligned. Associated with the reticle 18 is a collimating lens 25 which causes light received at the lens input to impinge on the reticle 18 and be modulated thereby, i.e., depending on where circumferentially the impinging light strikes the reticle 18, a function (the modulation) taken at a particular phase (or phases) of time is produced. (Because of this, the FIG. 2 elements of the reticle 18 may be operationally likened to the switches 12 of FIG. 1.) The modulated light emanating from the reticle 18 is focused by a lens 26 onto a photocell 28 which serves to "sum" the modulated light signals produced by the reticle 18, i.e., the FIG. 1 summing device 10 job is, in FIG. 2, performed by the photocell 28. An amplifier 30, receiving the photocell output signal, enhances it and applies it to a glow-discharge modulating tube 32, the modulating tube 32 then causing substantially equal intensity light to impinge on an area 34 of the reticle 20. The reticle area 34 should be at least the size of the aperture of the lens 25; in addition, both lenses 25 and 36 should see the same coded reticle sections and the tube 32 should illuminate such section on the reticle 20.

Since the reticle 20 opaque sections periodically interrupt the light from the modulating tube 32, it acts to modulate, i.e., gate or multiply, the "sum" illumination, an operation somewhat like that performed by the FIG. 1 elements 14; also, since the "sum" illumination falls on a reticle area the size of the lens aperture, the sum signal is simultaneously gated or multiplied by signals representing a function taken at as many possible phases as the input reticle 18 can produce them. Light passing through the reticle 20 is collimated by a lens 36 which causes it to impinge on a phosphorescent surface 38, the light integrating elements of which operates to provide the function afforded by each of the FIG. 1 integrators 16.

In FIG. 2 the input lens 25 is shown transmitting its output light to a small portion of the reticle 18 and not to the whole of the reticle. This is a matter of choice, and note should be here made that the area of reticle illumination is immaterial as far as the invention is concerned. What is important, however, is that the area 34 (output reticle 20) illuminated by the lamp 32 be at least equal to the area illuminated by the input lens 25.

Assume then that the "arbitrarily" coded reticle of FIG. 3 is used in place of both reticles 18 and 20, and in both cases is totally illuminable. Now, with the apparatus of FIG. 2 used, for example, to discern infrared targets and the light from a target impinging on the input reticle at position 1 (see FIG. 3), the photocell 28 is caused to detect infrared radiation when any one of the reticle transparent sections a through i is circumferentially aligned with position 1. With the reticle section a at position 1, the modulating tube 32 (which in our example floods the whole of the output reticle with equal intensity light) causes light to pass through the output reticle transparent sections a through i to illuminate related positions 1, 3, 7, 8, 10, 11 and 13 through 15 of the integrating phosphorescent screen 38; when the input reticle section b is at position 1, the phosphorescent screen is illuminated at related positions 1, 5, 6, 8, 9, 11 through 13 and 17, etc. See the chart associated with FIG. 3 for the phosphorescent screen positions which are illuminated when the input reticle transparent sections a through i are successively brought into alignment with position 1. For a complete revolution of the FIG. 3 reticle and a target at position 1, the screen 38 is illuminated at its related position 1 nine times, whereas its illumination at all other positions is approximately half as much, thereby indicating by means of peak light a target at position 1 in the view seen by the input lens.

In the above illustration of how the apparatus of FIG. 2 operates, the input "function of space" signal (i.e., position in the view seen by the input lens) was changed to a "function of time" signal by the operation of the modulating input reticle and the photocell 28, the function of time signal being then changed back to a "function of space" signal by operation of the output reticle and integrating screen 38; as a result correlation is in effect between a function of time (i.e., the signal applied to the modulating tube 32) and a function of space (i.e., the rotational position of the output reticle code). FIG. 4 shows a correlellogram (derived from the data in the FIG. 3 chart) which, to be noted, assumes the general shape of ordinary correlellogram.

Referring now to the multichannel correlator of FIG. 5, signals representing different functions, e.g., $f_1$ and $f_2$, which may be taken at different phases of time may be applied through switches 12' to a summing device 10'. The summing device 10' applies its sum signal output to banks of multiplying devices or gates **14*a'* and 14*b'*, each element in each bank being adapted to receive such sum signal. Also applied continually and simultaneously from a function generator 15' to the banks of multiplying devices are respective signals representing the input functions taken at various phases of time, i.e., at O, T, 2T . . . nT time displacements from a reference. The output signals, if any, from the banks of multiplying devices 14*a'* and 14*b'* are applied then to respective integrating devices (in banks 16*a'* and 16*b'***).

In FIG. 6, a reticle is shown which, when employed with the apparatus of FIG. 2, provides that apparatus with two-channel qualities. That is, incident light from targets impinging on the input reticle near its perimeter is time-coded according to the outer reticle pattern, whereas incident target light impinging near the axis of the reticle is time-coded according to the inner reticle pattern. Therefore, if target light impinges on the input reticle at positions X and Y, related sections of the integrating screen 38 will receive peak light by operation of the correlator elements 32, 20 and 36. Whereas the multichannel correlator provided by FIG. 6 is two-channel in nature, it is obvious that other coded rings may, for better resolution, as well be included. In fact, reticles may be made from film negatives made by photographing random arrangements of opaque and clear particles, e.g., sand, thereby providing coded reticles patterns that continuously change radially and circumferentially. Another presently preferred reticle coding technique is to code the reticles according to the L-sequence codes discussed in "Signals Having Good Correlation Functions," Robert M. Lerner, Lincoln Laboratories, MIT, Lexington, Mass.

While the invention has been described above in an optical environment, it is not so limited as indicated by the apparatus of FIG. 7. In FIG. 7, the invention is used to discern electrically which of a plurality of input leads have low level signals on them. The input leads 40 are connected electrically to insulated conductive sections 42 of an input disc 44 (which serves like the collimating lens 24 of FIG. 2). Axially aligned with the input disc 44 is an input coding wheel 46 comprising assorted conductive and nonconductive sections, all of the conductive sections being electrically connected by a conductive band 48.

As the wheel 46 is rotated by a motor 50, the capacitive couplng between the wheel and the input disc section (or sections) which is excited by a signal on its respective lead 40 is changed accordingto the coding of the wheel 46, thereby causing a small modulated signal to be developed across a resistor 52 electrically connected at one of its ends to the band 48 (by means of a brush) and at its other end to ground. The signal developed across the resistor 52 is then applied through a coupling capacitor 54 to a relay 56, the wheel 46 code pattern, capacitor 54 capacitance, and relay 56 sensitivity being such that the relay will pull in and drop out according to the code pattern.

When the relay 56 pulls in, it closes a switch 58, thereby causing a conductive disc 59 to be "flooded" by charges produced by a potential source 60. The disc 59, which is free to rotate or not rotate with the wheel 46, is electrically connected to the source 60 by means of a contact 62. Driven with the coded wheel 46 by the motor 50 is an identical coded wheel 64, the patterns of the wheels 46 and 64 being circumferentially aligned with each other. The band 66 of the wheel 64 is connected to ground by means of a wiper 68.

Since the disc 59 "floods" all (conductive and nonconductive) sections of the wheel 64 with charges, it acts somewhat like the reticle 20 of FIG. 2, with charges being caused to appear on the conductive sections 70 of disc 72, i.e. the disc 59 is capacitively coupled to the disc 72 through the coded wheel 64. The disc 72 is exactly like the disc 44 and is circumferentially aligned with that disc. To provide the integration necessary for the correlation operation, resistors are connected to each output disc section 70. Peak signal detection meters and the like may then be connected to the ungrounded ends of the capacitors 75 to determine which respective input lead (or leads) is excited.

While the invention has been described in its preferred embodiments, it is to be understood that the words which have been used are words of description rather than of limitation and that changes within the purview of the appended claims may be made without departing from the true scope and spirit of the invention in its broader aspects.

What is claimed is:

1. Signal handling apparatus comprising summing means adapted to receive simultaneously signals representing a function taken at one or more different phases of time, means providing simultaneously a plurality of signals representing said function taken at various phases of time, a plurality of multiplying means each of which receives the output signal from said summing means and one of the simultaneously provided function signals, and a plurality of integrating means simultaneously receiving the product output signals from respective multiplying means, whereby peak output signals from said integrating means is indicative of which respective multiplying means receive simultaneously provided signals having the same phases as the phases of the input signals to said summing means.

2. Signal handling apparatus comprising summing means adapted to receive simultaneously signals representing one or more of a plurality of functions taken at different phases of time, means simultaneously providing signals representing said plurality of functions taken at various phases of time, banks of multiplying devices for respective functions, each multiplying device in each bank being adapted to receive the output signal from said summing means and a respective function signal taken at a different phase of time, and banks of integrating means adapted to receive respective multiplying means output signals, whereby peak output signals from said integrating means is indicative of which respective multiplying means receive simultaneously provided signals having the same phases as the phases of the input signals to said summing means.

3. A correlator comprising mask means, means for moving said mask means, means for receiving a signal that varies as a function of time, said function being however taken at a particular phase with respect to a time reference, said signal receiving means beaming an equal intensity signal in proportion to the magnitude of said function signal to flood the area of said mask means, said mask means being provided with assorted signal conductive and signal blocking sections so arranged that when said mask means moves in a plane perpendicular to the beamed signal, the signal at each point in the shadow of said mask means is modulated to vary like said function but at different respective phases with respect to the time reference, said signal blocking and conductive sections being further arranged to permit the branch signal to be conducted through more than one conductive section at any given time and a plurality of integrating means for respective points in the shadow of said mask means adapted to receive the signals passing through said signal conductive sections of said mask means when said mask means moves, whereby the point whose respective integrating means receives a peak signal has a spatial position indicative of the phase at which said input function signal is taken.

4. The apparatus of claim 3 wherein said signal receiving means is a lamp, said signal conductive and blocking sections are respectively substantially transparent and opaque sections, and said integrating means are light sensitive elements.

5. A correlator comprising mask means, means for moving said mask means, means for receiving a signal that varies as a function of time, said function being however taken at a particular phase with respect to a time reference, said signal receiving means beaming an equal intensity signal in proportion to the magnitude of said function signal to flood the area of said mask means, said mask means being provided with assorted signal conductive and signal blocking sections so arranged that when said mask means moves in a plane perpendicular to the beamed signal, the signal at each point in the shadow of said mask means is modulated to vary like said function but at different respective phases with respect to the time reference, said signal blocking and conductive sections being further arranged to permit the branch signal to be conducted through more than one conductive section at any given time, and a plurality of integrating means for respective points in the shadow of said mask means adapted to receive the signals passing through said signal conductive sections of said mask means when said mask means moves, whereby the point whose respective integrating means receives a peak signal has a spatial position indicative of the phase at which said input function signal is taken, said signal receiving means beaming an electric field, said signal conductive and blocking sections being made respectively of electrically conductive and nonconductive material, and said integrating means being electric signal integrators.

6. Correlators apparatus comprising a rotatable disc having signal conductive and signal blocking sections, means adapted to receive signals representative of a function of time, said signal having any phase with respect to a time reference, said means adapted to receive signals directing in proportion to the instantaneous magnitude of its resultant received signal a signal that impinges on every point of an area on the face of said disc with equal intensity, said disc signal conductive and blocking sections being so arranged that an invariant signal directed at each point on said area of the disc face may be conducted through more than one section at any given time and become modulated when the disc rotates to change like said function but at respective phases with respect to time reference, and a plurality of signal integrating means positioned to receive signals directed through the signal conductive disc sections, whereby the integrating means which receive the largest signal have associated respective spatial points off the axis of said disc which are indicative of the signal phases which comprise the input function signal.

7. The apparatus of claim 6 wherein said disc signal conductive and blocking sections are substantially transparent and opaque respectively, said means directing a signal at said disc is a lamp, and said integrating means are each light sensitive.

8. Correlator apparatus comprising a rotatable disc having signal conductive and signal blocking sections, means adapted to receive signals representative of a function of time, said signal having any phase with respect to a time reference, said means adapted to receive signals directing in proportion to the instantaneous magnitude of its resultant received signal a signal that impinges on every point of an area on the face of said disc with equal intensity, said disc signal conductive and blocking sections being so arranged that an invariant signal directed at each point on said area of the disc face may be conducted through more than one section at any given time and become modulated when the disc rotates to change like said function but at respective phases with respect to time reference, and a plurality of signal integrating means positioned to receive signals directed through the signal conductive disc sections, whereby the integrating means which receive the largest signal have associated respective spatial points off the axis of said disc which are indicative of the signal phases which comprise the input function signal, said disc signal conductive and blocking sections being made of electrically conductive and non-conductive material respectively, said means directing a signal at said disc directing an electric field signal, and said integrating means being each an electrical integrator.

9. Correlator apparatus comprising means for receiving signals that vary respectively as one or more functions of time, for producing a resultant signal proportional to the instantaneous algebraic sum of said received signals each function of which may be at one or more different phases with respect to a time reference, a plurality of mask means, one for each of said functions, means for simultaneously moving said mask means, said signal receiving means directing said resultant signal at both said mask means which everywhere impinges on the mask means with substantially equal intensity, each of said mask means consisting of a different set of signal conductive and blocking sections so arranged that when said mask means moves in a plane substantially perpendicular to the direction of a constant impinging signal the signals at different points in the shadows of the respective mask means are made to vary like said functions but at different phases with respect to the time reference, said signal blocking and conductive sections being further so arranged that more than one conductive section may conduct an impinging signal at any given time and a plurality of integrating means for respective points in the shadows of said mask means adapted to receive the signals passing through said signal conductive sections of said mask means when said mask means moves, whereby the point or points whose respective integrating means receive peak signals are made to have spatial positions indicative of the phases of said functions which comprise the input signal.

* * * * *